United States Patent [19]

Akashi

[11] 4,312,103

[45] Jan. 26, 1982

[54] SEPARABLE SLIDE FASTENER

[75] Inventor: Shunji Akashi, Kurobe, Japan

[73] Assignee: Yoshida Kogyo K K, Tokyo, Japan

[21] Appl. No.: 155,003

[22] Filed: May 30, 1980

[30] Foreign Application Priority Data

Jun. 21, 1979 [JP] Japan ..... 54-85147[U]

[51] Int. Cl.[3] ..... A44B 19/36

[52] U.S. Cl. ..... 24/205.11 F; 24/205.16 R

[58] Field of Search ..... 24/205.11 F, 205.16 R

[56] References Cited

U.S. PATENT DOCUMENTS

| | | | |
|---|---|---|---|
| 3,030,684 | 4/1962 | Johns et al. | 24/205.11 F |
| 3,503,102 | 3/1970 | Inazawa | 24/205.15 C X |
| 3,922,761 | 12/1975 | Schwendt | 24/205.11 F |
| 4,090,279 | 5/1978 | Wasko | 24/205.11 F |
| 4,138,771 | 2/1979 | Manning | 24/205.11 F |
| 4,232,432 | 11/1980 | Akashi | 24/205.11 F X |
| 4,244,087 | 1/1981 | Akashi | 24/205.11 F X |

*Primary Examiner*—Roy D. Frazier
*Assistant Examiner*—Peter A. Aschenbrenner
*Attorney, Agent, or Firm*—Bucknam and Archer

[57] ABSTRACT

A separable slide fastener has a separable end stop assembly including a pair of pin members each formed, by injection molding, on one of a pair of fastener stringers along a bottom end portion of an inner longitudinal edge thereof, and means for holding the pair of pin members in collateral relation to couple the stringers at their bottom ends. A pair of reinforcing wing members are each formed integrally with one of the pin members and extend therefrom so as to overlie an inner marginal portion of one reinforcing film attached to a respective one of stringer tapes. Each wing member has an outer edge extending substantially parallel to one of the pin members and disposed slightly outwardly of an outermost side edge of a slider.

3 Claims, 8 Drawing Figures

SEPARABLE SLIDE FASTENER

BACKGROUND OF THE INVENTION

1. Field of the Invention

The present invention relates to a slide fastener, and more particularly to a separable slide fastener having a separable bottom end stop assembly.

2. Prior Art

U.S. Pat. No. 3,030,684, issued Apr. 24, 1962 to Jones et al., discloses a separable slide fastener having a separable bottom end stop assembly comprising a pin member on one stringer and a socket member on the other stringer, the pin and socket members being formed on the stringers by injection molding and being releasably interlockable with each other to couple the stringers at their bottom ends. For the reinforcement purposes, a bottom end portion of each stringer is sandwiched by a pair of reinforcing parts integrally formed with and projecting from one of the pin and socket members. However, because the reinforcing parts, which have a great stiffness, extend up to an outer margin of the stringer, a sewing needle is difficult to smoothly penetrate through the stringer at its bottom end portion during the slide fastener is being sewn to a garment. Further, with such prior separable slide fastener, smooth coupling and uncoupling operation of the pin and socket members is difficult to achieve.

A solution to the above problems is disclosed in U.S. Pat. No. 3,503,102, issued Mar. 31, 1970 to Inazawa. According to the U.S. Pat. No. 3,503,102 a bottom end portion of the individual stringer is reinforced by a pair of synthetic resin films attached thereto one on each side while no reinforcing wings or projections are formed on either the pin member or the socket member. Thus the stringers are sufficiently flexible even at their bottom end portions, making the slide fastener capable of being smoothly sewn to a garment. However, the stringer tapes are liable to excessively bend at portion adjacent the pin and socket members, and as a result, the portions would become crumpled or otherwise damaged before long. With the tape portions thus damaged, smooth and reliable coupling and uncoupling operation of the pin and socket member is difficult to achieve. Another disadvantage of this prior art separable slide fastener is that the connections of the pin and socket members with the stringer tapes are not sufficiently firm.

SUMMARY OF THE INVENTION

It is therefore an object of the present invention to provide a separable slide fastener having an improved separable bottom end stop assembly which enables smooth and reliable coupling and uncoupling of the fastener stringers at their bottom ends.

Another object of the invention is to provide a separable slide fastener which has a sufficient degree of flexibility and hence can be sewn to a garment without difficulty.

Still another object of the invention is to provide a durable separable slide fastener having a separable bottom end stop assembly which are attached to the fastener stringers with an increased degree of bonding strength.

According to a separable slide fastener of the present invention, a separable bottom end stop assembly comprises a pair of pin members each formed, by injection-molding, on one of a pair of fastener stringers along a bottom end portion of an inner longitudinal edge thereof, and means for holding the pair of pin members in collateral relation to couple the stringers at their bottom ends. A pair of reinforcing wing members are each formed integrally with one of the pin members and extend therefrom so as to overlie an inner marginal portion of a reinforcing film attached to a respective one of stringer tapes. Each wing member has an outer edge extending substantially parallel to one of the pin members and disposed slightly outwardly of an outermost side edge of a slider.

The above and other objects and features as well as additional advantages of the present invention will become manifest to those versed in the art when reference has been made to the following description in conjunction with the accompanying drawings which illustrate a preferred embodiment of the invention by way of example.

DETAILED DESCRIPTION OF THE PREFERRED EMBODIMENT

Figure 1:
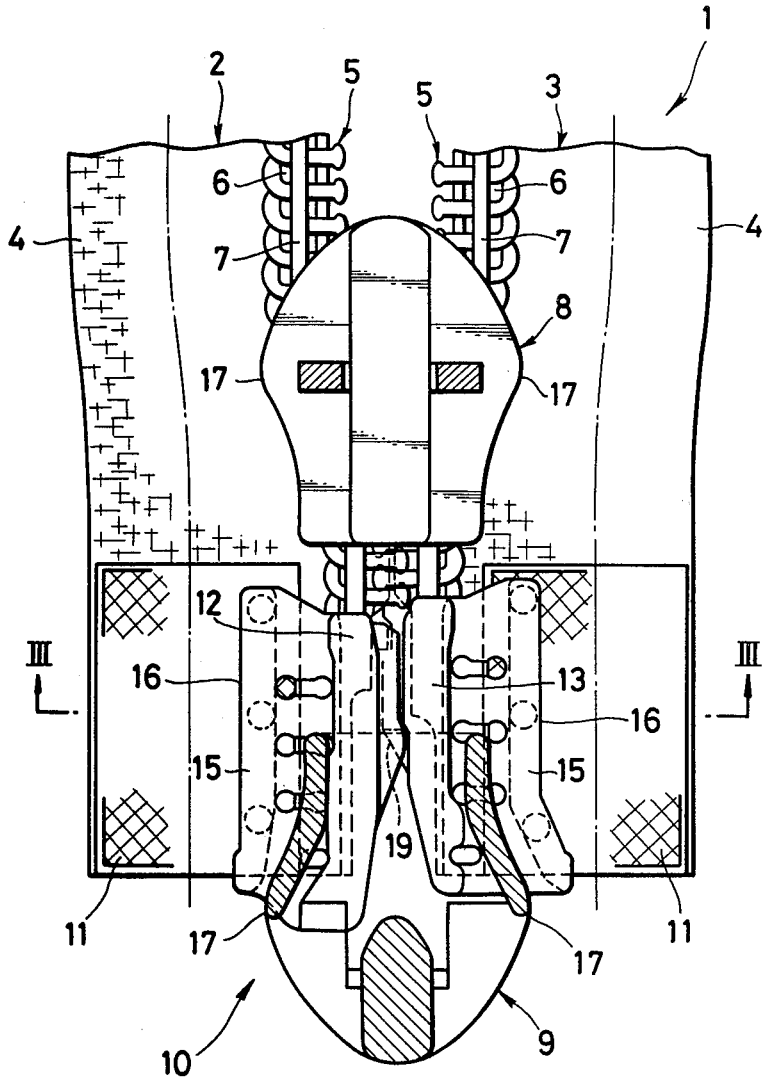
FIG. 1 is a fragmentary plan view of a separable slide fastener embodying the present invention.

The principles of the present invention will be particularly useful when embodied in a separable slide fastener such as shown in FIG. 1, generally indicated by the numeral 1.

The separable slide fastener 1 comprises a pair of fastener stringers 2,3 each including a stringer tape 4 and a row of helically coiled interlocking elements 5 mounted on one side of the stringer tape 4 along an inner longitudinal edge thereof. A filler cord 6 extends centrally in and through the row of interlocking elements 5. The interlocking elements 5 are sewn to the stringer tape 4 with a thread 7 passing through the filler cord 6.

A pair of first and second sliders 8,9 are threaded on the opposed fastener stringers 2,3 and each slider is slidable on and along the opposed rows of interlocking elements 5,5 for coupling and uncoupling the same to close and open the slide fastener 1. The first and second sliders 8,9 are oppositely disposed so that the rows of interlocking elements 5,5 can be uncoupled from either end of the slide fastener 1. The second slider 9 also serves as the socket part of a separable bottom end stop assembly 10, as described below.

The stringer tapes 4,4 are reinforced at their bottom end portions as by a pair of plastic films 11,11, respectively, adhesively attached or otherwise fixed to the bottom end portions.

The separable bottom end stop assembly 10 comprises a first pin member 12 on one stringer 2, a second pin member 13 on the other stringer 3, and means for holding the first and second pin members 12,13 in collateral relation to couple the stringers 2,3 at their bottom end portions. In the illustrated embodiment this holding means is the second slider 9. Alternatively, the holding means may be a box-like socket part integrally formed with the first pin member 12 for reciving the second pin member 13 in collateral relation to the first pin member 12, as is well known in the art.

The first and second pin members 12,13 are each formed, by injection molding, directly on one of the stringers 2,3 along a bottom end portion 14 (FIG. 3) of its inner longitudinal edge, the bottom end portion 14 being raised above the general plane of the tape 4 by hot injection molding described below.

Figure 3:
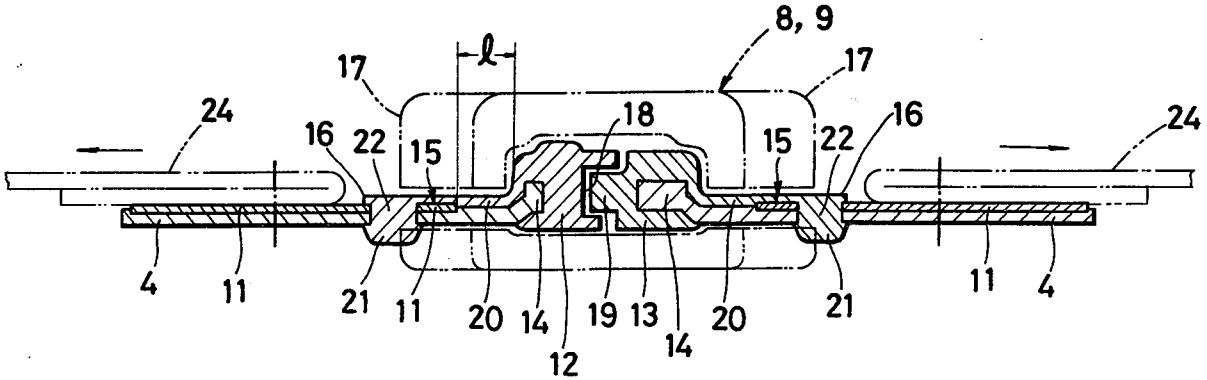
FIG. 3 is an enlarged cross-sectional view taken along line III—III of FIG. 1 with a slider indicated by phantom lines.
Figure 5:
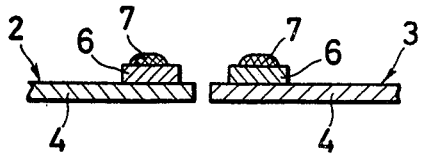
FIG. 5 is a cross-sectional view taken along line V—V of FIG. 4.

As shown in FIGS. 1 and 3, each of the first and second pin members 12,13 is provided with a reinforcing wing member 15 integrally formed therewith and projecting therefrom so as to overlie an inner marginal portion of one reinforcing film 11. Each reinforcing wing member 15 has an outer edge 16 extending substantially parallel to a respective one of the pin members 12,13 and disposed slightly outwardly of an outermost side edge 17 of the slider 8(9). With such reinforcing wing members 15, the reinforcing films 11,11 can be prevented nicely from becoming peeled, crumpled or otherwise damaged at their inner marginal portions. This not only guarantees smooth and reliable coupling and uncoupling operation of the separable bottom end assembly 10, but also does not prevent smooth movement of the slider 8,9 onto the pin members 12,13.

The first pin member 12 has a guide groove 18 (FIG. 3) extending in and along its inner surface for receiving a ridge 19 (FIGS. 1 and 3) projecting from an inner surface of the second pin member 13.

Each reinforcing film 11 extends transversely of one of the stringers 2,3 from its outer longitudinal edge toward its inner longitudinal edge and terminates short of the latter; that is to say, an inner edge of each reinforcing film 11 is spaced a distance l (FIGS. 3) apart from one of the pin members 12,13. This allows the individual wing 15,15 to have an increased thickness portion 20 (FIGS. 3) at such reinforcing-film-free area.

Figure 2:
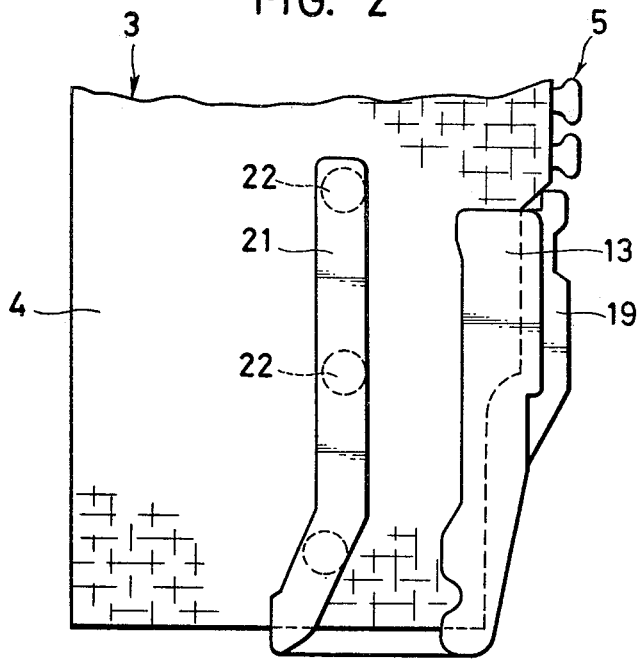
FIG. 2 is a view showing the reverse side of one stringer shown in FIG. 1.

Each reinforcing wing 15,15 overlies the inner marginal portion of one reinforcing film 11 and is bonded thereto. The reinforcing wing 15 is connected to a rib 21 (FIGS. 2 and 3) disposed on the other side of the tape 4 by a plurality of bridges 22 (FIG. 3) extending through a plurality of openings 23 (FIG. 7), respectively, formed in the tape 4 and the reinforcing film 11. The rib 21 and the bridges 22 on each stringer 2,3 are formed integrally with the reinforcing wing 15 on that stringer 2,3. This arrangement ensures firm connection of the individual pin member 12(13) with the reinforcing film 11 and the stringer tape 4.

Each wing member 15 extends from one of the pin members 12,13 toward an outer longitudinal tape edge, but terminates far short of that tape edge so that a sewing needle (not shown) is not prevented from smoothly penetrating through the stringer 2,3 even at the bottom end portion thereof during the slide fastener 1 is being sewn to a garment 24 (FIG. 3). For this purpose, the outer edge 16 of each wing member 15 is disposed slightly outwardly of the outermost side edge 17 of the slider 8,9.

Figure 4:
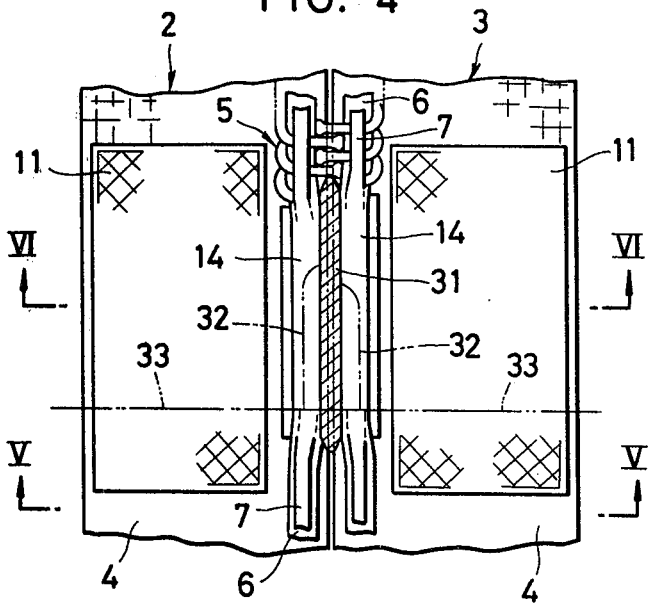
FIG. 4 is a fragmentary plan view of a pair of continuous slide fastener stringers for the separable slide fastener of FIG. 1, showing the manner in which bottom end portions of the stringers are formed.
Figure 6:
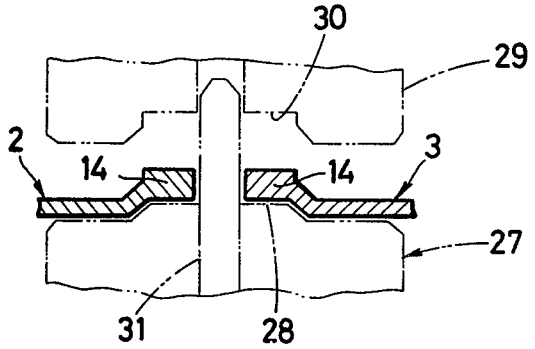
FIG. 6 is a cross-sectional view taken along line VI—VI of FIG. 4.
Figure 7:
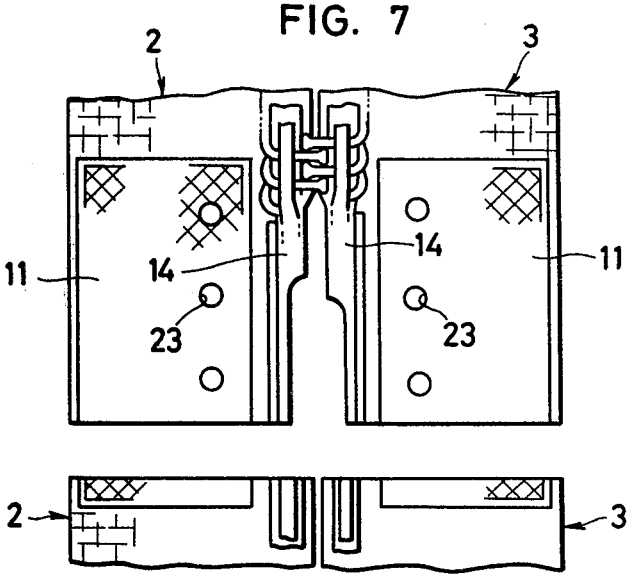
FIG. 7 is a view similar to FIG. 4 but showing the stringers as they have been cut off to form the bottom end portions.

FIGS. 4 to 7 illustrate the manner in which the raised bottom end portions 14,14, to which the first and second pin members 12,13 are to be mounted, are formed. The pair of continuous fastener stringers 2,3 having a plurality of element-free tape portions is placed on a lower die 27 (FIG. 6) with the element-free tape portions on a land 28 of the lower die 27. An upper die 29 is then lowered toward the lower die 27 until the element-free tape portions are compressed between the land 28 of the lower die 27 and a recess 30 of the upper die 29 and thereby shaped into the raised bottom end portions 14,14 each having a rectangular cross section, as shown in FIG. 6. During the compressing operation, the upper and lower dies 27,29 are heated as by means of an ultrasonic or high-frequency heater. A stop 31 (FIG. 4 and 6) projects through such element-free opening in the continuous stringers 2,3 during this hot compression molding operation. Then the stringers 2,3 are cut along dash-and-two-dot lines 32,33 (FIG. 4). And the openings 23 (FIG. 7) for the passage of the bridges 22 (FIG. 3) are formed in the stringers 2,3 as by means of a punch (not shown). FIG. 7 shows the resulting fastener stringers 2,3 having the raised bottom end portions 14,14.

Then the first and second pin members 12,13 are injection-molded directly on these raised bottom end portions 14,14, respectively.

Figure 8:
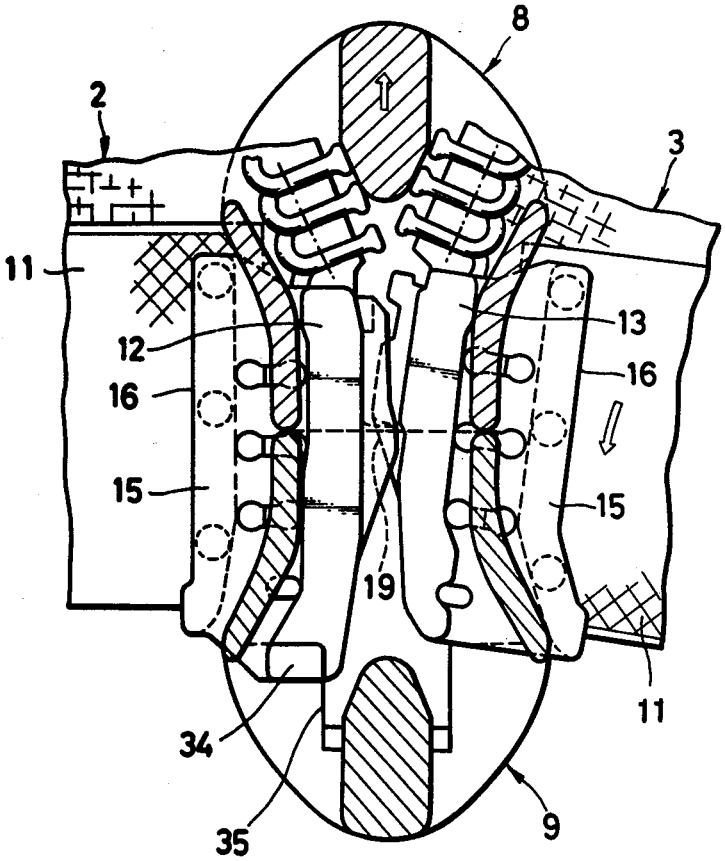
FIG. 8 is a view similar to FIG. 1 but showing the manner in which the bottom end stop assembly are coupled.

FIG. 8 illustrates the manner in which the opposed stringers 2,3 are coupled. If the first slider 8 is pulled upwardly, i.e. toward the top end of the slide fastener 1, the opposed rows of the interlocking elements 5,5 are progressively coupled, and at the same time, the first and second pin members 12,13 are held in collateral relation in the second slider 9. Downward movement of the second slider 9 is restricted by a stop 34 on the bottom end of the first pin member 12, the stop 34 being engageable with a stepped portion 35 on the second slider 9.

Although various minor modifications may be suggested by those versed in the art, it should be understood that I wish to embody within the scope of the patent warranted thereon all such embodiments as reasonably and properly come within the scope of my contribution to the art.

What is claimed is:

1. A separable slide fastener comprising:

(a) a pair of fastener stringers each including a stringer tape and a row of interlocking fastener elements supported on one side of said stringer tape along an inner longitudinal edge thereof;

(b) a slider threaded on said pair of fastener stringers and slidable along such pair of rows of interlocking fastener elements for coupling and uncoupling the same to close and open said slide fastener;

(c) a pair of reinforcing films each attached to a bottom end portion of one of such two stringer tapes, said each reinforcing film being disposed on said one side of said stringer tape; and (d) a separable bottom end stop assembly including (1) a pair of pin members each formed, by injection molding, on one of said fastener stringers along a bottom end portion of an inner longitudinal edge thereof, (2) means for holding said pair of pin members in collateral relation to couple said fastener stringers at said bottom end portions thereof, (3) a pair of reinforcing wing members each formed integrally with one of said pin members and extending therefrom so as to overlie an inner marginal portion of one of said reinforcing films, said each wing member having an outer edge extending substantially parallel to said one of said pin members and disposed slightly outwardly of an outermost side edge of said slider, and (4) a pair of ribs each disposed on the other side of said one of said stringer tapes and connected to said one of said reinforcing wing members by a plurality of bridges extending through said one of said reinforcing films and said one of said stringer tapes.

2. A separable slide fastener according to claim 1, said each rib and said bridges thereof being formed integrally with said one of said reinforcing wing members.

3. A separable slide fastener comprising:

(a) a pair of fastener stringers each including a stringer tape and a row of interlocking fastener elements supported on one side of said stringer tape along an inner longitudinal edge thereof;

(b) a slider threaded on said pair of fastener stringers and slidable along such pair of rows of interlocking fastener elements for coupling and uncoupling the same to close and open said slide fastener;

(c) a pair of reinforcing films each attached to a bottom end portion of one of such two stringer tapes, said each reinforcing film being disposed on said one side of said stringer tape;

(d) a separable bottom end stop assembly including (1) a pair of pin members each formed, by injection molding, on one of said fastener stringers along a bottom end portion of an inner longitudinal edge thereof, (2) means for holding said pair of pin members in collateral relation to couple said fastener stringers at said bottom end portions thereof, and (3) a pair of reinforcing wing members each formed integrally with one of said pin members and extending therefrom so as to overlie an inner marginal portion of one of said reinforcing films, said each wing member having an outer edge extending substantially parallel to said one of said pin members and disposed slightly outwardly of an outermost side edge of said slider; and (e) the inner marginal portion of said each reinforcing film being spaced apart from said one of said pin members to define therebetween a reinforcing-film-free area, said each reinforcing wing having an increased thickness at said reinforcing-film-free area.

* * * * *